United States Patent [19]

Anseel

[11] Patent Number: 5,028,013

[45] Date of Patent: Jul. 2, 1991

[54] WIRE TAKE-OFF APPARATUS AND PAY-OFF INSTALLATION COMPRISING SUCH APPARATUSES

[75] Inventor: Freddy Anseel, Kortrijk-Marke, Belgium

[73] Assignee: N.V. Bekaert S.A., Bekaertstraat, Belgium

[21] Appl. No.: 439,640

[22] Filed: Nov. 20, 1989

[30] Foreign Application Priority Data

Dec. 2, 1988 [NL] Netherlands ..... 8802981

[51] Int. Cl.[5] ..... B65H 49/02; B65H 59/02

[52] U.S. Cl. ..... 242/128; 242/54 R; 242/147 R

[58] Field of Search ..... 242/128, 129, 147 R, 242/54 R

[56] References Cited

U.S. PATENT DOCUMENTS 2,552,086 5/1951 Bugg ..... 242/128

FOREIGN PATENT DOCUMENTS

| | | |
|---|---|---|
| 804840 | 3/1974 | Belgium . |
| 2244355 | 4/1975 | France . |
| 1149327 | 4/1969 | United Kingdom . |
| 2101085A | 1/1983 | United Kingdom . |
| 2161506A | 1/1986 | United Kingdom . |

*Primary Examiner*—Stanley N. Gilreath

*Attorney, Agent, or Firm*—Shlesinger & Myers

[57] ABSTRACT

The invention relates to an apparatus that can be connected to one of the flanges of a spool with wire for the purpose of axially taking off wire from the spool and at least comprising two spaced apart annular elements that are coaxial with the axis of the spool and that have an outside diameter that is larger than the outside diameter of the flange in question of the spool and a cylindrical bearing surface being provided between the two annular elements that is coaxial with the spool axis for a band of slightly stretchable material loosely fitting round it, whereby one of the two annular elements is rotatable on its axis and the other is fixedly mounted and in that the cylindrical bearing surface is fixedly connected to one of the two annular elements.

12 Claims, 2 Drawing Sheets

WIRE TAKE-OFF APPARATUS AND PAY-OFF INSTALLATION COMPRISING SUCH APPARATUSES

The invention relates in the first place to an apparatus that can be connected to one of the flanges of a spool with wire for the purpose of axially taking off wire from the spool and at least comprising two spaced apart annular elements that are coaxial with the axis of the spool and that have an outside diameter that is larger than the outside diameter of the flange in question of the spool and a cylindrical surface being provided between the two annular elements that is coaxial with the spool axis for a band of slightly stretchable material loosely fitting round it.

Such an apparatus is known from the Belgian patent specification 804840 in the name of the present applicant.

In said patent publication is used an apparatus of the described type for axially taking off metal wire from a stationary spool, the wire being taken off running round over both smooth edges of the two annular elements present in the apparatus and the band of slightly stretchable material present ensuring that during pay-off the wire keeps resting against said annular elements and is not slung outwards by centrifugal force.

This known wire take-off apparatus is most satisfactory for the controlled take-off of many types of wires and cords; still, in certain cases problems do occur that may lead to wire rupture.

Such a situation occurs for instance when during the take-up of the wire onto the spool, a winding gets jammed between the other windings as a result of the wire being wound under too high a tension; when the so-called sticking effect occurs because the windings stick to each other during the annealing of the wire on the spool as a result of the drawing-soap rests present on them; etc.

If such jamming or sticking occurs, the result may be wire rupture, which causes the occurrence of interruptions in the wire take-off process which have a very detrimental effect on production.

It is the object of the present invention to provide an apparatus of the type described hereinabove that is, however, less susceptible to such interruptions and with which wire rupture occurs far less frequently or hardly ever.

To that end, the apparatus is characterised in accordance with the invention in that of the two annular elements present in the apparatus one is rotatable on its axis and the other is fixedly mounted and in that the cylindrical surface is fixedly connected to one of the two annular elements.

It has been found that a so-called loosening effect occurs if one of the two annular elements is made to be rotatable on its axis.

Without wishing to be tied down to a theoretical explanation it is assumed that the energy of the unwound or taken-off wire is transferred to the rotating annular element as a result of which the loosening effect occurs. Indeed, it is found that when taking off the wire at a certain line speed, the rotatably mounted annular element turns along very slowly or hardly at all at the beginning (or with full spool) or at low speed of revolutions.

As, during the further unwinding of the spool, the speed of revolutions increases or the diameter of the windings becomes smaller and smaller (for the windings located closer to the spool core), the speed of the rotatably mounted annular element also increases as a result of which the loosening effect increases.

In connection with the invention as described hereinabove it is noted that the application of a rotatably mounted annular element in an apparatus for taking off wire from a spool is known in itself from the British patent specification 1 149 327.

In said publication is described the application of a single rotatably mounted annular element in combination with tines of flexible material resting against said element that are connected to a fixedly mounted mandrel.

The insight that such a rotatably mounted annular element has a loosening effect on the wire to be taken off cannot be derived from said publication. Indeed, as soon as the speed of revolutions becomes sufficiently high, the wire will be slung sufficiently far outwards by the centrifugal force (ballooning effect) and will no longer be braked by the tines of flexible material. In the case of the apparatus in accordance with the invention, however, the energy of the unwound wire is transferred to the rotating annular element via the band. So, the placing of the band of slightly stretchable material between a rotatably mounted annular element and a fixedly mounted element is necessary to prevent the ballooning effect and to thus transfer the energy of the unwound or taken-off wire to the rotatably mounted annular element.

A very favourable effect is obtained if, when the apparatus is in use, the rotatably mounted annular element, measured along the axis of the spool, is closest to the flange thereof to which the apparatus is connected and the fixedly mounted annular element is farthest from said flange while the cylindrical surface is connected to the fixedly mounted annular element.

In the way described hereinbefore, the wire taken off from the spool first comes in contact with the rotatably mounted annular element, which results in an optimum loosening effect.

Suitably, the cylindrical surface that is connected to one of the two annular elements, will be provided with a radially protruding collar on the side opposite the annular element concerned, the outside diameter of said collar being larger than the diameter of the band of slightly stretchable material loosely fitting round the cylindrical surface.

Obviously, such a collar is particularly important if the cylindrical surface is connected to the fixedly mounted annular element, which, measured in axial direction, is farthest from the flange, as described hereinbefore, as said collar in that case prevents the band from sliding off the cylindrical surface.

Advantageously, the above described apparatus in accordance with the invention is provided with a lifting lug which makes it easy to place the apparatus on a spool to be unwound.

Finally, the invention relates to a pay-off installation for unwinding wire from one or more spools that is at least provided with a take-off apparatus for taking wire off the spool and with wire guiding means, for each of the spools to be treated a wire take-off apparatus being present that can be connected to one of the flanges of the spool with wire for the purpose of axially taking off the wire from said spool, characterised in that the wire take-off apparatus applied is formed by an apparatus as described hereinbefore in accordance with the invention.

The invention will now be described with reference to the accompanying drawing in which.

Figure 1:
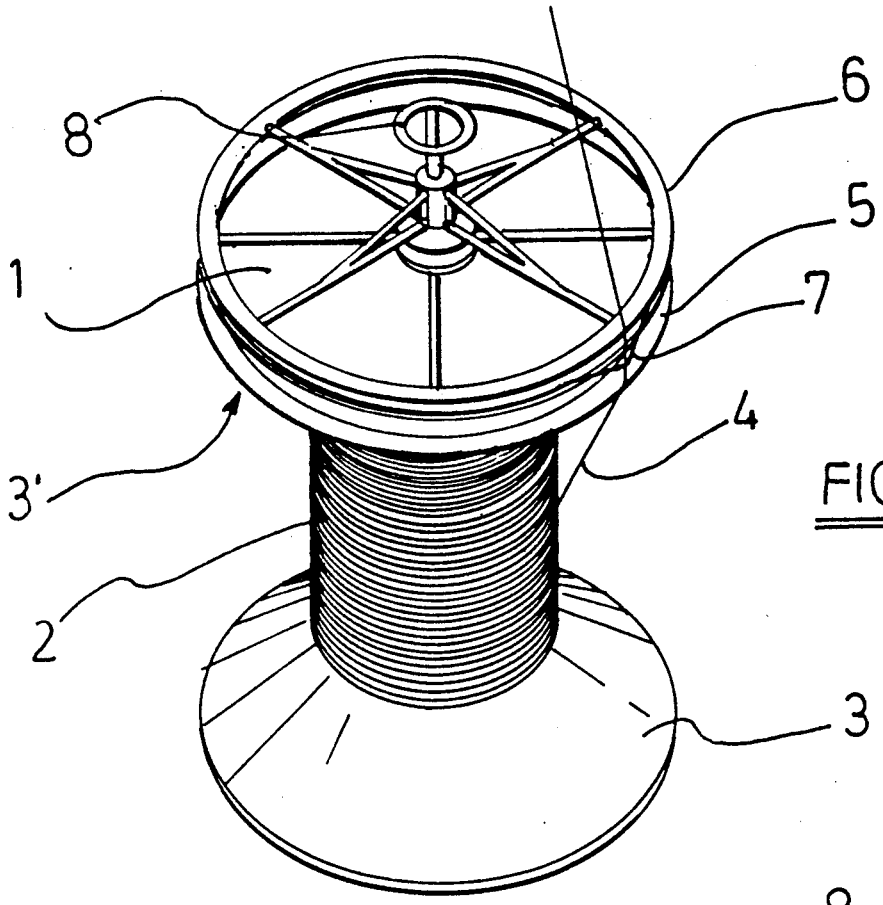
FIG. 1 represents a spool with wire wound on it that is provided with a wire take-off apparatus in accordance with the invention.

FIG. 1 represents a wire take-off apparatus 1 placed on a spool 2 with conical flanges 3 and 3'. The wire 4 is taken off over the head of the spool by means of the wire take-off apparatus and the wire take-off apparatus 1 therefore consists of two annular elements 5 and 6 with a cylindrical surface between them that is yet to be described in detail and that is provided with a band 7 of slightly stretchable material that serves for preventing the wire 4 from being slung too far outwards due to the centrifugal force. A lifting lug 8 makes it easy to place the apparatus 1 on the spool 2 that is to be unwound.

The diameter of the band 7 is such that it is smaller than the outside diameters of the annular elements 5 and 6, so that the band cannot pass said elements.

Throughout the take-off operation, the wire 4 rests against the surface of the annular elements 5 and 6 and also touches the inner side of the band 7 of slightly stretchable material.

Figure 2:
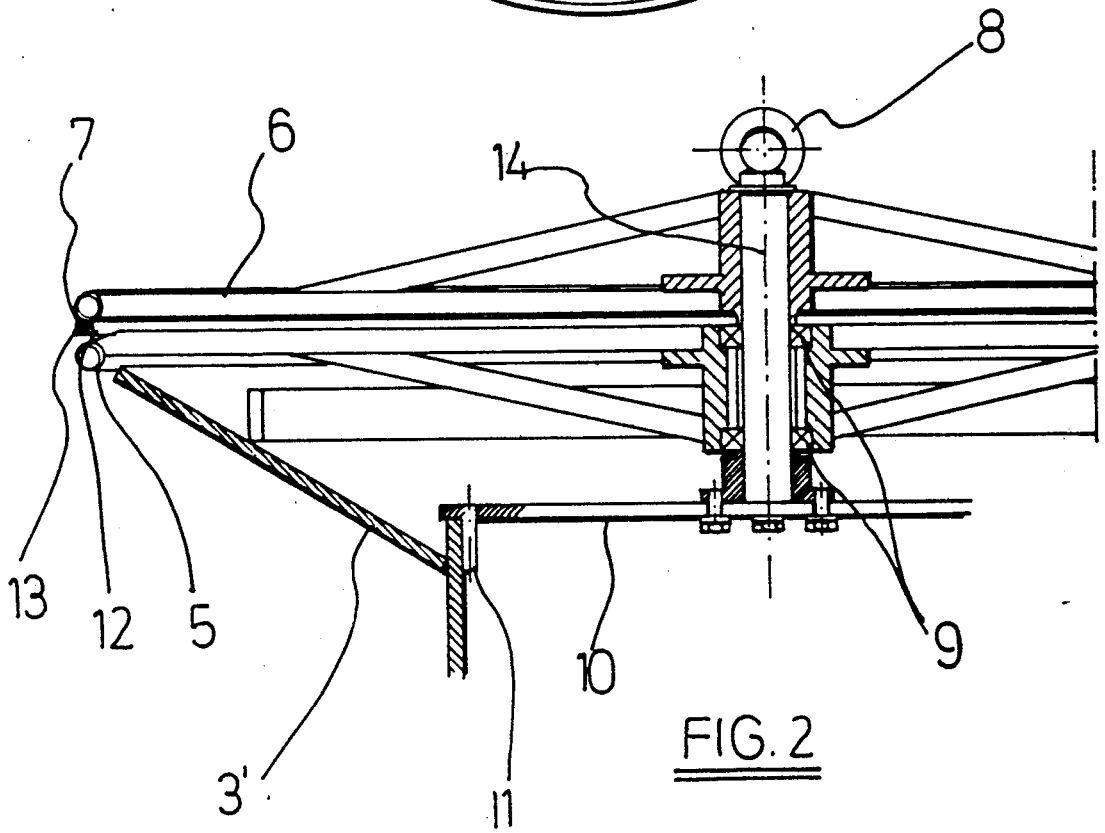
FIG. 2 is a sectional view on an enlarged scale of a wire take-off apparatus in accordance with a first embodiment and FIG. 3 represents a wire take-off apparatus in accordance with the invention in another embodiment.

In FIG. 2 the wire take-off apparatus schematically represented in FIG. 1, is shown in detail.

Of the two annular elements, the annular element 5 is rotatably mounted on the axis 14 whereas the annular element 6 is fixedly mounted on the axis 14.

The cylindrical surface 12 is connected to the fixedly mounted annular element 6 and is provided with a radially protruding collar 13 the outside diameter of which is larger than the inside diameter of the band 7. When the apparatus is at rest, the band 7 is supported by the radially protruding collar 13.

The annular element 5 is rotatably mounted on the axis 14 through the application of bearings 9.

The spool body of the spool has a conical flange 3' at its end; here, the take-off apparatus in accordance with the invention is fitted on a sheet 10 which, as schematically indicated with 11, is connected to the spool spool body.

When the apparatus is in use, the wire 4 is slung outwards by the centrifugal force (ballooning effect). The band 7 checks this outward movement as a result of which the wire actuates the rotating annular element 5. At high speeds, higher than 100 meters/minute for instance, and with wire diameters of from 0.2 to 3 mm, preferably of from 0.3 mm to 2.5 mm, these centrifugal forces will be sufficiently high so as to successfully apply the loosening effect described hereinabove; as a result of which the number of occurring wire ruptures will strongly decrease.

As a result, the average percentage of a spool with wire to be taken off comes very close to 100%.

Figure 3:
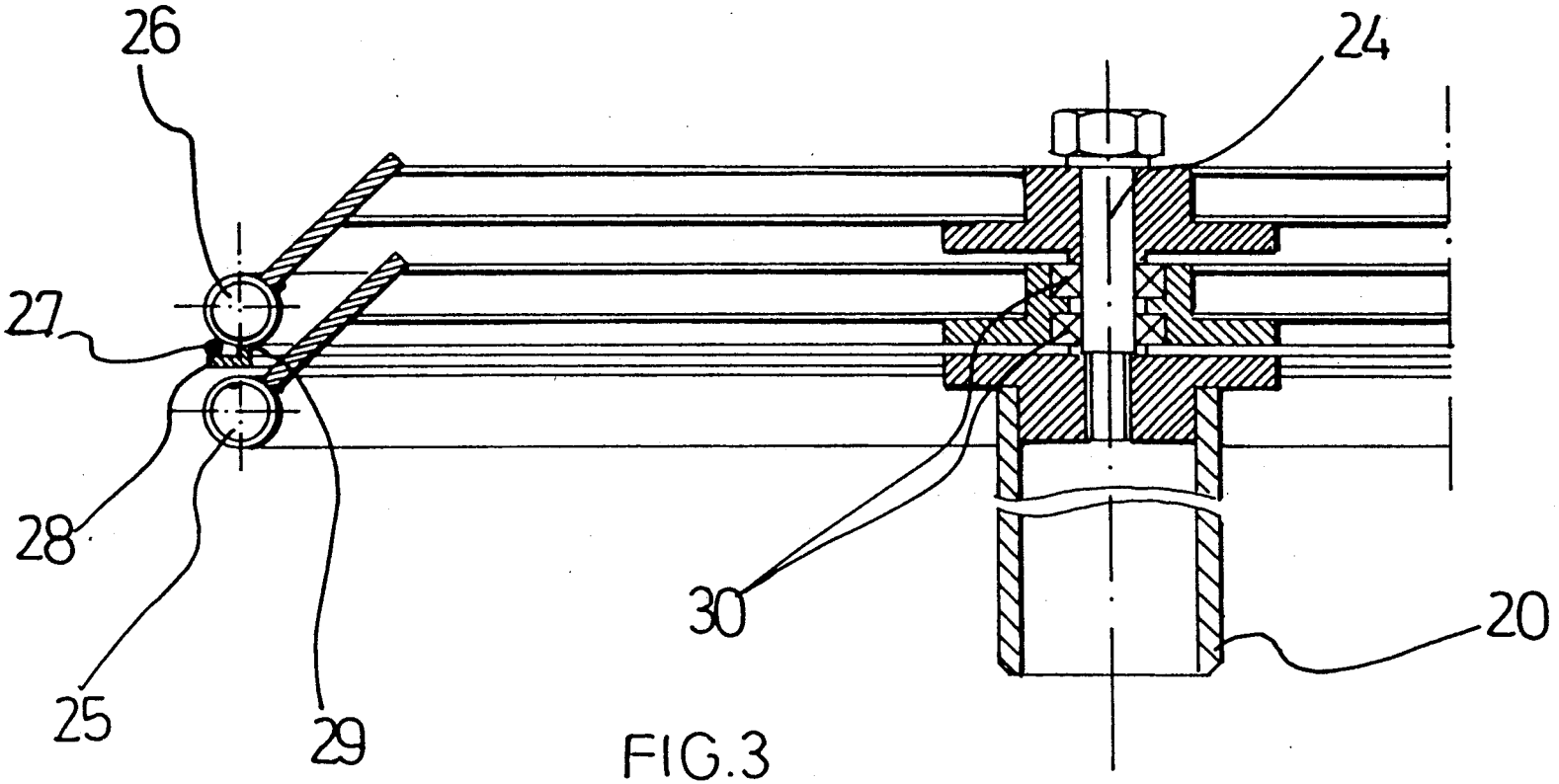

FIG. 3 shows the apparatus in accordance with the invention for application with a spool with straight flanges.

The annular elements 25 and 26 are fitted in such a way that the annular element 25 is rotatable whereas the annular element 26 is fixedly mounted. The cylindrical surface 29 with the collar 28 is connected to the annular element 26 for supporting the band 27. The annular element 25 is rotatably mounted on the axis 24 through the application of bearings 30.

The apparatus can be incorporated by means of a central sleeve 20 into a matching bore which is located round the axis 24 of the spool with which the take-off apparatus in accordance with the invention is to cooperate.

With great advantage, the wire take-off apparatus of the invention described hereinbefore can be applied to the take-off of metal wire or metal cord from a spool; however, the apparatus can also be successfully applied to the take-off of wire of synthetic material from a spool.

Suitably, the band applied in the apparatus in accordance with the invention can either be a slightly stretchable metal band or a slightly stretchable cord, the surface of the wire or cord being coated, if so desired, with a suitable synthetic material that is preferably of a type with low adhesion to pollution.

A material that is suitable as a coating can for instance be formed by polytetrafluorethylene, polypropylene, etc. Obviously, the band can also be made of a suitable synthetic material that is resistant to wear and which shows little adhesion to pollution.

In any case, when forming the wire by welding for instance, one will have to take care that the weld is finished as smoothly as possible.

I claim:

1. An apparatus for axially paying off wire wound in a spool, said apparatus comprising:
   a) at least first and second annular elements operably associated with each other and disposed coaxial with an axis of the spool;
   b) each of said first and second elements having a diameter larger than an outside diameter of a flange of the spool;
   c) said first element being rotatable about its axis and said second element being non-rotatable about its axis;
   d) a cylindrical surface disposed between said first and second elements and coaxial with the spool axis and operably associated with one of said first and second elements;
   e) a band around said cylindrical surface for securing the wire from the spool to permit the wire to engage said first and second elements;
   f) whereby the wire during a pay-off operation causes said first element to rotate to loosen the wire from the spool.

2. An apparatus as in claim 1, wherein:
   a) said band is slightly stretchable and loosely fitted around said cylindrical surface.

3. An apparatus as claimed in claim 1, wherein:
   a) said first element is disposed adjacent the spool flange during use.

4. An apparatus as in claim 1, wherein:
   a) said surface is secured to said second element.

5. An apparatus as in claim 1, and further comprising:
   a) a radially extending collar secured to said cylindrical surface and disposed away from the spool axis; and
   f) said collar has an outside diameter larger than an inside diameter of said band.

6. An apparatus as in claim 1, and further comprising:
   a) a lifting lug secured to one of said first and second elements.

7. An apparatus comprising:

a) a wire spool having a flange at each end thereof and having an axis;

b) at least first and second annular elements operably associated with one of said spool flanges and disposed coaxial with the axis of said spool;

c) each of said first and second elements having a diameter larger than an outside diameter of said spool flange;

d) said first element being rotatable about its axis and said second element being non-rotatable about its axis;

e) a cylindrical surface disposed between said first and second elements and coaxial with the spool axis and secured to one of said first and second elements;

f) a cylindrical surface disposed between said first and second elements and coaxial with the spool axis and operably associated with one of said first and second elements;

g) a band around said cylindrical surface for securing the wire from the spool to permit the wire to engage said first and second elements;

h) whereby the wire during a pay-off operation causes said first element to rotate to loosen the wire from the spool.

8. An apparatus as in claim 7, wherein:

a) said band is slightly stretchable and loosely fitted around said cylindrical surface.

9. An apparatus as in claim 7, wherein:

a) said first element is disposed adjacent one of said spool flanges during use.

10. An apparatus as in claim 7, wherein:

a) said surface is secured to said second element.

11. An apparatus as in claim 7, and further comprising:

a) a radially extending collar secured to said cylindrical surface and disposed away from the spool axis; and h) said collar has an outside diameter larger than an inside diameter of said band.

12. An apparatus as in claim 7, and further comprising:

a) a lifting lug secured to one of said first and second elements.

* * * * *